US005222870A

United States Patent [19]

Budzich, deceased

[11] Patent Number: 5,222,870

[45] Date of Patent: Jun. 29, 1993

[54] FLUID SYSTEM HAVING DUAL OUTPUT CONTROLS

[75] Inventor: Tadeusz Budzich, deceased, late of Moreland Hills, Ohio, by Euphemia A. M. Budzich, executrix

[73] Assignee: Caterpillar Inc., Peoria, Ill.

[21] Appl. No.: 892,920

[22] Filed: Jun. 3, 1992

[51] Int. Cl.[5] ..... F04B 1/26

[52] U.S. Cl. ..... 417/222.1; 60/452; 60/468

[58] Field of Search ..... 417/218, 222 R; 60/452, 60/468

[56] References Cited

U.S. PATENT DOCUMENTS

| | | | |
|---|---|---|---|
| 3,820,920 | 6/1974 | Klimaszewski et al. | 417/218 X |
| 4,107,924 | 8/1978 | Dezelan | 417/218 X |
| 4,379,389 | 4/1983 | Liesener | 60/452 X |
| 4,383,412 | 5/1983 | Presley | 60/452 X |
| 4,518,322 | 5/1985 | Nonnenmacher | 417/218 X |
| 4,523,430 | 6/1985 | Masuda | 60/450 X |
| 4,892,465 | 1/1990 | Born et al. | 60/452 X |
| 5,094,597 | 3/1992 | Takai et al. | 417/428 |
| 5,129,230 | 7/1992 | Izumi et al. | 60/452 |

*Primary Examiner*—Richard A. Bertsch
*Assistant Examiner*—Michael I. Kocharov
*Attorney, Agent, or Firm*—J. W. Burrows

[57] ABSTRACT

The flow changing response of fluid systems having variable displacements pumps are greatly effected by the inertia of the displacement changing mechanisms, such as, the swashplate and at least half of the fluid pumping piston assemblies. In the present invention, a fluid system is provided which has a first flow changing mechanism operable to maintain a relatively constant pressure differential across a variable orifice device in a valve mechanism to change the flow of the fluid being delivered from the fluid pump to the fluid system. Simultaneously therewith, a second flow changing mechanism having a fast acting bypass mechanism acts in parallel with the first flow changing mechanism to more quickly bypass fluid being delivered from the fluid pump to the fluid system thus eliminating pressure spikes in the fluid system. The second flow changing mechanism is operable to establish a second larger differential pressure across the variable orifice device. Therefore the first flow changing mechanism normally has priority over the second flow changing mechanism.

12 Claims, 3 Drawing Sheets

FLUID SYSTEM HAVING DUAL OUTPUT CONTROLS

TECHNICAL FIELD

This invention relates generally to a fluid system having a variable displacement pump and more particularly to the control of the fluid from the variable displacement pump to the fluid system.

BACKGROUND ART

Load responsive systems have been used in the past to improve the efficiency of fluid systems and also to improve the quality of the controls in the systems. One of the basic controls of the load responsive system is the load responsive pump control, which is made responsive to the largest of the system loads and automatically maintains a relative constant pressure differential across a variable orifice of a control valve interposed between the pump and the largest load. Systems today normally require fast response of the control and therefore fast response of the load responsive pump control. In many systems having large flow requirements at high pressure, a variable displacement piston pump is used. These variable displacement pumps, especially those delivering high flows, are characterized by the large inertia of their displacement changing mechanisms. In the case of a cantilever piston type pump having a swashplate, the inertia of the displacement changing mechanism consists not only of the large inertia of the swashplate but also half of the total inertia of all the working piston assemblies in contact with the swashplate. The cantilever piston type pump is the most commonly used in both variable displacement system pumps working in the range of high pressures and the majority of hydrostatic transmissions. In order to provide a reasonable response of the flow changing mechanism of such a pump, as a rule, two stage controls are used. It is difficult to obtain a fast response of such a pump control, since the second stage control is subjected to the comparatively low forces resulting from relatively small pressure differentials. When controlling such pumps, it is difficult to obtain fast response due to the large inertia of the pump displacement changing mechanism and it is also difficult to obtain fast response in pumps generating very high flows. Even if the swashplate could be moved quickly from a maximum flow condition to a minimum flow condition, the harmful side effect of cavitation could occur in the pumping chambers and/or the system could be subjected to large pressure spikes during such large flow transients.

The present invention is directed to overcoming one or more of the problems as set forth above.

DISCLOSURE OF THE INVENTION

In one aspect of the present invention, a fluid system having dual output controls is provided. The fluid system includes a fluid pump operative to receive fluid from a reservoir and a fluid motor connected to the fluid pump and operative to move a load. A valve means is provided in the system and interposed between the fluid pump and the fluid motor and is operative to control movement of the load. A control means is provided to selectively control the valve means between various operating conditions. The fluid system includes a first mean for changing the flow rate from the fluid pump to the fluid system and has a pump displacement changing means for varying the flow delivered from the fluid pump to the fluid system in response to the operating conditions of the valve means. The fluid system also includes a second means for changing the flow rate from the fluid pump to the fluid system and operates in parallel with the first means. The second flow changing means includes a flow bypass means for varying the flow delivered from the fluid pump to the fluid system in response to the operating conditions of the valve means.

The present invention provides a fluid system having two basic types of flow controls to govern the output flow of fluid from the fluid pump to the fluid system. The first flow changing means acts to control the fluid flow being delivered from the fluid pump during normal flow changes which are acting at a relatively slow rate. Since the flow changes are small, the inertia of the components involved are small. Therefore, the first flow changing means effectively and efficiently controls the volume of fluid being delivered from the fluid pump to the fluid system. The second flow changing means, which is operating at a higher differential pressure, acts very fast to rapidly decrease the effective flow rate of the fluid flow being delivered to the fluid system. Therefore, although the effective fluid flow output to the fluid system is being rapidly reduced, the fluid flow output of the fluid pump is reducing at a much slower rate due to its inertia. Consequently, the combined response of these two types of controls, working in parallel, is extremely fast during very high fluid flow changes occurring in a very short time. Furthermore, the subject arrangement generally eliminates the generation of excessive pressure spikes.

BEST MODE FOR CARRYING OUT THE INVENTION

Figure 1:
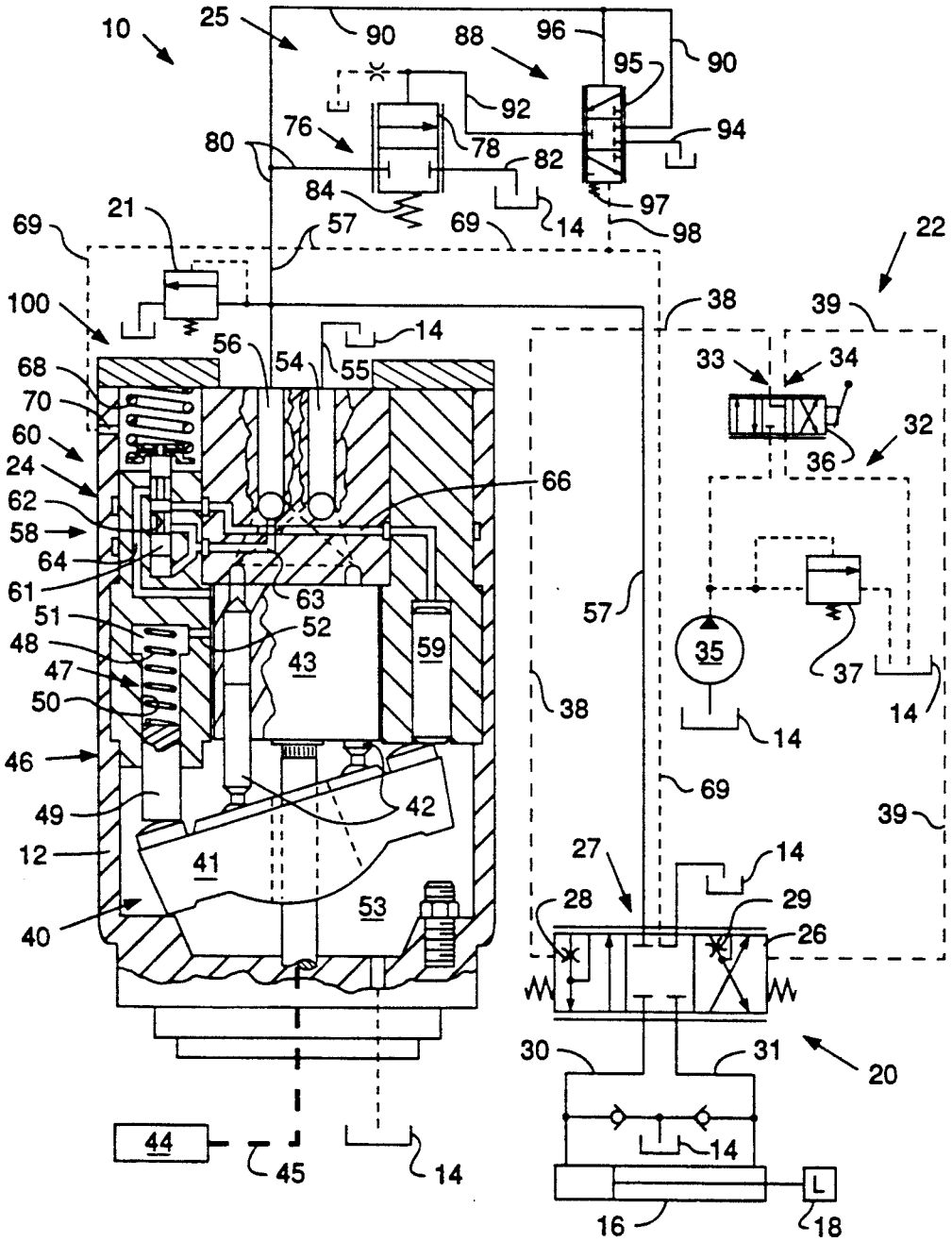
FIG. 1 is a partial schematic and partial diagrammatic representation of an embodiment of the present invention.

Referring now to the drawings and in particular to FIG. 1, a fluid system 10 is illustrated including a fluid pump 12 operative to communicate pressurized fluid from a reservoir 14 to a fluid motor, such as a cylinder 16, to move a load 18. A valve means 20 is interposed between the fluid pump 12 and the cylinder 16 and is operative to control movement of the load 18. A conventional pressure relief valve 21 is connected between the fluid pump 12 and the valve means 20 to limit the maximum pressure level in the fluid system 10. A control means 22 is provided in the system to selectively control the valve means 20 between various operating conditions. The fluid system 10 further includes first means 24 for changing the flow rate from the fluid pump 12 to the fluid system 10 and a second means 25 for changing the flow rate from the fluid pump 12 to the fluid system 10. The first and second flow changing means 24,25 operate in parallel with each other.

The valve means 20 includes a directional control valve 26, well known in the art, having variable orifice means 27 for allowing a controlled amount of fluid flow to pass thereacross depending on the degree of actuation of the directional control valve 26. The variable orifice means 27 is in the form of metering orifices 28,29. The directional control valve 26 is biased to a neutral flow blocking position. Conduits 30,31 operatively connect the directional control valve 26 to opposite ends of the cylinder 16.

The control means 22 includes signal generating means 32 for producing control signals 33,34. The signal generating means 32 includes a source of pressurized fluid, such as a pilot pump 35, a pilot valve 36, and a conventional pilot pressure relief valve 37. The respective control signals 33,34 are in the form of pressurized fluid being delivered from the pilot pump 35, selectively controlled by the pilot valve 36, and communicated through pilot conduits 38,39 to opposite ends of the directional control valve 26 for selective movement thereof.

The fluid pump 12 is a variable displacement pump and includes a pump displacement changing means 40, such as, a swashplate 41 and a plurality of pistons 42 slidably disposed in a rotating barrel mechanism 43. A source of power, such as an engine 44, is drivingly connected to the rotating barrel mechanism 43, in a conventional manner, by a drive shaft mechanism 45. A force generating means 46 is provided in the fluid pump 12 for biasing the swashplate 41 to its maximum flow displacement position. The force generating means 46 includes spring biasing means 47 including a spring 48 and a first slug 49 slidably disposed in a bore 50. The first slug 49 being disposed in the bore 50 defines a chamber 51. The chamber 51 is in fluid communication with the reservoir 14 through a case drain passage 52 and a case drain 53. As is well known, an inlet port 54 of the fluid pump 12 receives fluid from the reservoir 14 through a conduit 55 and directs the fluid to the plurality of pistons 42. An outlet port 56 delivers the pressurized fluid from the plurality of pistons 42 to the directional control valve 26 through a conduit 57.

A pump control means 58 is disposed in the fluid pump 12 and is operative to control the position of the swashplate 41 in response to various operating conditions of the valve means 20. The pump displacement changing means 40 further includes a second slug 59 selectively responsive to the discharge pressure of the fluid pump 12 to move the swashplate 41 towards a minimum flow condition. The pump control means 58 includes pilot valve means 60 for selectively directing pressurized fluid from the fluid pump 12 to the second slug 59 and to selectively vent the pressurized fluid from the second slug 59 to the reservoir 14. The pilot valve means 60 includes a valving element, such as a spool 61, slidably disposed in a bore 62. A passage 63 connects the outlet port 56 to the bore 62 of the pilot valve means 60 while a passage 64 connects the bore 62 of pilot valve means 60 to the case drain 53. A passage 66 connects the bore 62 of the pilot valve means 60 with the second slug 59. The spool 61 operates to control communication between the respective passages 63,64,66.

The spool 61 of the pilot valve means 60 is movable between a pressure balanced position at which the passage 66 is blocked from the passages 63,64, a first operative position at which the passage 63 is in fluid communication with the passage 66, and a second operative position at which the passage 66 is in fluid communication with the passage 64. The spool 61 of the pilot valve means 60 is biased towards the first operative position in response to a force representative of the pressurized fluid from the outlet port 56 acting on one end of the spool 61. The spool 61 is movable towards its second operative position in response to the combined forces of a spring 68 and a force representative of the load 18 acting on the other end of the spool 61. The load pressure signal needed to generate the force representative of the load 18 is directed to the other end of the spool 61 in a conventional manner by a conduit 69 connected between the directional control valve 26 and a load signal port 70 defined in the fluid pump 12. The pilot valve means 60 is operable to vary the position of the swashplate 41 to maintain a relatively constant pressure differential across the variable orifice means 27 of the valve means 20. The pressure level of the constant pressure differential across the variable orifice means 27 is equal to the quotient of the preload of the spring 68 and the cross-sectional area of the spool 61.

The second flow changing means 25 includes a flow bypass means 76 which is operatively connected to the outlet port 56 of the fluid pump 12. The flow bypass means 76 includes a bypass valve means 78. The bypass valve means 78 is connected between the outlet port 56 of the fluid pump 12 and the reservoir 14 by respective conduits 80,82. The bypass valve means 78 is spring biased towards a fluid flow blocking position by a spring 84 wherein communication between conduits 80 and 82 is blocked and movable to a fluid flow communicating position at which the conduits 80 and 82 are in open communication. The bypass valve means 78 is moved towards its fluid flow communicating position in response to pressurized fluid being directed thereto in opposition to the biasing force of the spring 84.

A pilot valve means 88 of the second flow changing means 25 is operable to controllably move the bypass valve means 78 from the flow blocking position towards the open communicating position to maintain a relatively constant pressure differential across the variable orifice means 27 of the valve means 20. The pilot valve means 88 is connected to the outlet port 56 of the fluid pump 12 by a conduit 90, to the bypass valve means 78 by a conduit 92, and to the reservoir 14 by a conduit 94. The pilot valve means 88 includes a valving element 95 movable from a neutral flow blocking position towards a first operative position at which the conduit 90 is connected to conduit 92 and a second operative position at which the conduit 92 is connected to the conduit 94 and the conduit 90 is blocked. The pilot valve means 88 is biased towards its first operative position by a force representative of the pressurized fluid from the outlet port 56 of the fluid pump 12. The pressurized fluid is directed thereto through a conduit 96 connected to the conduit 90. The valving element 95 is biased towards the second operative position in response to the combined forces of a spring 97 and a force representative of the load 18 as directed thereto through a conduit 98 connected to the conduit 69. The pressure level of the constant pressure differential across the variable orifice means 27 is equal to the quotient of the preload of the spring 97 and the cross-sectional area of the valving element 95.

The preload of the spring 68 of the pilot valve means 60 of the first flow changing means 24 is less than the preload of the spring 97 of the pilot valve means 88 of the second flow changing means 25. Furthermore the cross-sectional area of the spool 61 in the pilot valve means 60 is the same as the cross-sectional area of the valving element 95 in the pilot valve means 88. Therefore, the differential pressure established by the pilot valve means 60 of the first flow changing means 24 is less than the differential pressure established by the pilot valve means 88 of the second flow changing means 25. Consequently, the first flow changing means 24 has priority over the second flow changing means 25. With the cross-sectional areas of the spool 61 and the valving element 95 being the same, the difference in the preload of the spring 68 of the pilot valve means 60 of the first flow changing means 24 and the preload of the spring 97 of the pilot valve means 88 of the second flow changing means 25 constitutes priority means 100.

Figure 2:
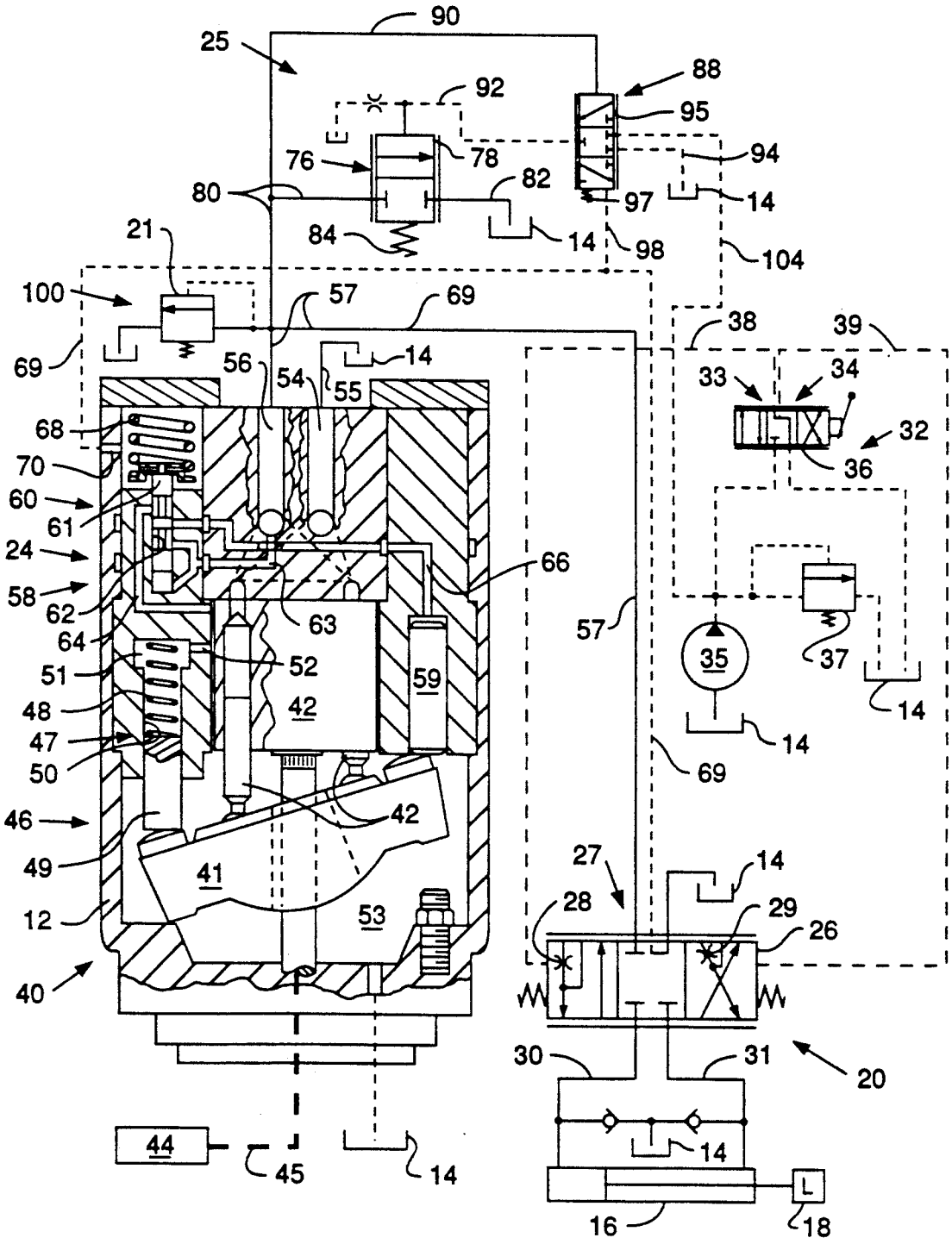
FIG. 2 is a partial schematic and partial diagrammatic representation of another embodiment of the present invention.

Referring now to FIG. 2, the fluid system 10 is quite similar to the fluid system 10 of FIG. 1. In this embodiment, elements that are the same or similar to elements from the previous embodiment have the same element numbers.

The valving element 95 of the pilot valve means 88 is movable towards its first and second operative positions the same as that in FIG. 1. The major difference between the embodiment of FIG. 1 and the embodiment of FIG. 2 is that the energy needed to move the bypass valve means 78 is supplied by the pilot pump 35 of the force generating means 32. The pressurized fluid from the pilot pump 35 is directed to the bypass valve means 78 through a conduit 104, the pilot valve means 88, and the conduit 92. All other aspects of the embodiment of FIG. 2 are the same as those set forth with respect to FIG. 1.

Figure 3:
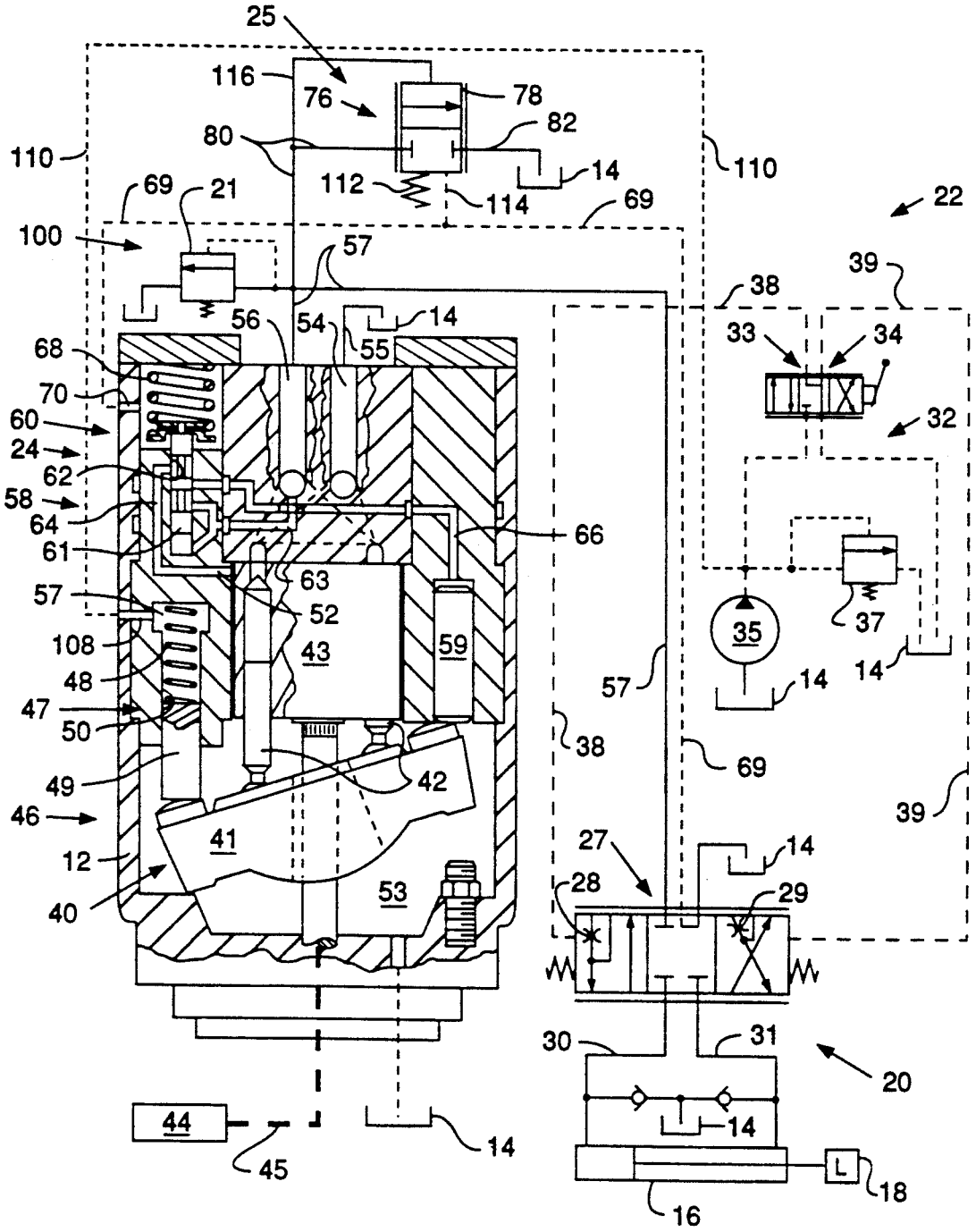
FIG. 3 is a partial schematic and partial diagrammatic representation of yet another embodiment of the present invention.

Referring to FIG. 3, another embodiment of the fluid system 10 is illustrated. In this embodiment, elements that are the same or similar to elements from the previous embodiments have the same element numbers.

The fluid pump 12 of the subject embodiment has been slightly modified. The case drain passage 52 connecting chamber 51 with the case drain 53 has been removed and an inlet passage 108 is provided to connect the chamber 51 with the pilot pump 35 through a pilot conduit 110. All other aspects of the fluid pump 12 are the same as that set forth with respect to FIG. 1 above.

The bypass valve means 78 of the subject embodiment is a single stage bypass valve means. Consequently, the pilot valve means 88 of the previous embodiments is not needed and is omitted. The single stage bypass valve means 78 is biased towards its flow blocking position by the combined forces of a spring 112 and a pressure signal representative of the load 18 acting on one end thereof. The load pressure signal is directed to the single stage bypass valve 78 by a pilot conduit 114 connected to the pilot conduit 69. The single stage bypass valve 78 is movable towards its fluid bypassing position in response to the discharge pressure of the fluid pump 12 from the outlet port 60 being directed to the other end thereof through a conduit 116 connected to the conduit 80. The force created by the discharge pressure of the fluid pump 12 acting on the other end of the single stage bypass valve 78 acts in opposition to the biasing force of the spring 112 and the force created by the signal representative of the load 18. Therefore, the single stage bypass valve means 78 maintains a pressure differential across the variable orifice means 27 equivalent, as well known in the art, to the quotient of the preload of the spring 112 and the cross-sectional area of the bypass means 78. The preload of the spring 112 is so selected as to produce a differential pressure that is larger than the differential pressure produced by the pilot valve means 60 of the first flow changing means 24.

It is recognized that various forms of the fluid system 10 could be utilized without departing from the essence of the invention. For example, the valve means 20 could be manually operated as opposed to being pilot operated. Likewise, the control signals 33,34 created by the signal generating means 32 could be in the form of electrical signals produced in various known ways. Furthermore, even though the fluid pump 12 is illustrated as a swashplate type of pump having control means integrally formed therein, the fluid pump 12 could be of other known types with other known controls.

INDUSTRIAL APPLICABILITY

During operation of the subject fluid system 10, the operator selectively provides an input to the pivot valve 36 to produce a control signal 33/34 which in turn moves the directional control valve 26 to the desired operating position. Assuming the operator's input moves the directional control valve 26 to a position opening the pressurized conduit 57 to the conduit 30 to establish the orifice 28 of a predetermined size. The load 18 is now conditioned to move to the right as viewed in the drawings. In a well known manner, the signal representative of the load 18 is directed through pilot line 69 and load signal port 70 to act on the end of the spool 61 in conjunction with the spring 68. The spool 61 moves to its second operative position to communicate passage 66 with the drain passage 64. The force of the spring 48 of the pump displacement changing means 40 moves the swashplate 41 towards its maximum flow displacement position, as illustrated in the drawings. As the rate of flow increase, the pressure of the fluid in the outlet port 56 increases. The pressurized fluid in outlet port 56 is directed to the other end of the spool 61 through the passage 63 and acts in opposition to the force of the spring 68 and the force established by the load pressure signal directed thereto. The spool 61 moves to its neutral flow blocking position once the opposing forces are balanced. Once the spool 61 is in its neutral flow blocking position, the constant differential pressure is established across the orifice 28 and the load 18 moves at a controlled rate of speed. The differential pressure across the orifice 28 is, in a well known manner, determined by the quotient of the preload of the spring 68 and the cross-sectional area of the spool 61.

Simultaneously, the pressurized fluid at the outlet port 56 of the fluid pump 12 is directed to one end of the valving element 95 of the pilot valve means 88 and the load pressure signal of the load 18 is directed to the other end thereof to act in conjunction with the spring 97 to oppose the force of the discharge pressure. Since the preload of the spring 97 is larger than the preload of the spring 68, the pilot valve means 88 is maintained in its second operative position which connects conduit 92 to the reservoir 14 through the conduit 94. Therefore, the bypass valve means 78 is maintained in its flow blocking position due to the force of the spring 84.

When it is desired to make a small adjustment to the speed of the load 18, the operator reduces the control signal 33 produced by the pilot valve 36 which moves the directional control valve 26 to a position that changes the orifice 28 to a smaller size. Since the size of the orifice 28 is smaller, the differential pressure across the orifice 28 changes thus offsetting the force balance acting on the spool 61. The smaller orifice 28 results in an increase in the pressure upstream of the orifice 28 which is simultaneously sensed on the end of the spool 61 opposite the end thereof contacting the spring 68.

The spool 61 is moved to its first operative position at which the passage 63 is connected to the passage 66. The pressurized fluid in the passage 66 acting on the second slug 59 moves the swashplate 41 towards its minimum flow position. As the swashplate 41 moves towards its minimum flow position, the pressure level in the discharge port 56 reduces. The pressure level of the fluid in the outlet port 56 continues to reduce as the swashplate 41 continues to move until the force balance on the spool 61 is once again reached. Once the force balance is reached, the spool 61 is at its neutral flow blocking position thus stopping the movement of the swashplate 41. During this small adjustment of the speed of the load, the change in the differential pressure across the orifice 28 is not large enough to affect the pilot valve means 88. Consequently, the bypass valve means 78 remains in its flow blocking position.

When the operator desires to make a larger adjustment to the speed of the load, the change in the differential pressure across the orifice 28 is likewise larger. The larger differential pressure is sensed by the first flow changing means 24 moving the spool 61 to its first operative position. For example, if the speed of the load is quickly reduced, the spool 61 moves to its first operative position at which the pressurized fluid from the outlet port 56 is directed to the second slug 59 through the passage 66. The pressurized fluid acting on the second slug 59 results in movement of the swashplate 41 towards its minimum flow position. Since the inertia of the mass of the swashplate 41 and at least half of the plurality of pistons 42 must be overcome, the movement thereof is not instant and is not extremely fast. Consequently, the fluid system 10 experiences an increase in pressure during this lag in time. It is recognized that the pressure relief valve 21 limits the maximum pressure level in the fluid system 10, but during this time lag period the fluid system 10 is potentially subjected to very high pressures.

Simultaneously, the high differential pressure across the orifice 28 is acting on the valving element 95 of the pilot valve means 88 of the second flow changing means 25. The higher differential pressure acting on the valving element 95 moves it to its first operative position connecting the conduit 90 to the conduit 92. Since the conduit 90 is connected to the discharge pressure of the fluid pump 12, The bypass valve means 78 moves to its bypass position allowing pressurized fluid from the outlet port 56 to bypass to the reservoir 14. Since the mass of the valving element 95 and the mass of the bypass means 78 are relatively small, the inertia thereof is likewise very small. Therefore, the bypass valve means 78 opens very quickly to bypass pressurized fluid from the outlet port 56 to the reservoir 14 thus generally eliminating the possibility of pressure spikes in the fluid system 10.

Once the swashplate 41 has had sufficient time to respond to the increased differential pressure and moves to a position near the point where a pressure balance is again obtained at the spool 61, the bypass valve means 78 returns to its flow blocking position. This is attributed to the fact that once the differential pressure has reduced to a level lower than the effective force of the spring 97, the valving element 95 returns to its neutral flow blocking position. As previously mentioned, the first flow changing means 24 now controls the volume of the pressurized fluid at the outlet port 56.

The above sequence of events normally occur only when the speed of the load is being reduced. When the speed is being increased it is not necessary to bypass fluid flow from the outlet port 56.

The operation of the fluid system 10 illustrated in FIG. 2 is basically the same as that described with respect to FIG. 1 above. The only difference being that when the valving element 95 of the pilot valve means 88 moves to its first operative position the pressurized fluid being directed thereacross comes from the pilot pump 35 of the signal generating means 32. In some fluid systems, where the discharge pressure of the variable fluid pump 12 is permitted to drop to a very low pressure level, the response of the flow bypass means 78 can be greatly improved by connecting it to a separate energy source, such as the signal generating means 32.

The operation of the fluid system 10 illustrated in FIG. 3, is generally the same as that with respect to FIG. 1. One of the main differences is that the bypass valve means 78 is a single stage bypass valve means. Since the pilot valve means 88 is not used in the subject embodiment, the single stage bypass valve means 78 directly responds to establish the differential pressure across the respective orifices 27,28 as a function of the preload of the spring 112. Once the differential pressure in the fluid system 10 is sufficiently high, the single stage bypass valve means 78 responds to bypass pressurized fluid from the outlet port 56 to the fluid reservoir 14.

Another difference in the operation of the fluid system 10 illustrated in FIG. 3 is that the first slug 49 of the pump displacement changing means 40 is connected with the pilot pump 35 of the signal generating means 32. The force exerted on the first slug 49 aids the spring 48 in moving the swashplate 41 more quickly. The response of the pump control in the direction to increase the displacement of the fluid pump 12 must be very carefully selected in order not to create the very undesirable condition of cavitation, which reduces the life of the fluid pump 12 and increases the noise generated thereby. In many fluid systems utilizing the subject invention, the frequency of the volume of fluid flow being throttled by the flow bypass means 76 is comparatively small. Consequently, the fluid system 10 of FIG. 3, having a single stage bypass valve means 78, is much simpler and less expensive than the flow bypass means 76 described with respect to FIGS. 1 and 2.

In view of the foregoing, it is readily apparent that the fluid system of the present invention provides fast response of the system without allowing high pressure spikes while not adversely effecting the proportionality and quality of the controls. The subject fluid system 10 not only increases the life of the fluid pump 12 but also makes interfacing of such fluid systems with electronic computing circuits much easier.

Other aspects, objects, and advantages of this invention can be obtained from a study of the drawings, the disclosure, and the appended claims.

I claim:

1. A fluid system having dual output control, comprising:

a fluid pump operative to receive fluid from a reservoir;

a fluid motor connected to the fluid pump and operative to move a load;

valve means for controlling movement of the load, the valve means being interposed between the fluid pump and the fluid motor;

control means for selectively controlling the valve means between various operating conditions;

first means for changing the flow rate from the fluid pump to the fluid system, the first means including pump displacement changing means for varying the fluid flow delivered from the fluid pump to the fluid system in response to the operating conditions of the valve means;

second means for changing the flow rate from the fluid pump to the fluid system, the second means operating in parallel with the first means and includes flow bypass means for varying the flow delivered from the fluid pump to the fluid system in response to the operating conditions of the valve means; and priority means for ensuring that the fluid flow delivered from the fluid pump to the fluid system is varied first by the first flow changing means and when the flow changing capability of the first flow changing means is exceeded to vary the fluid flow delivered from the fluid pump to the fluid system through the second flow changing means.

2. The fluid system of claim 1 wherein the valves means includes variable orifice means and the first flow changing means includes pump control means for varying the fluid flow delivered from the fluid pump to the fluid system to maintain a relatively constant pressure differential across the variable orifice means.

3. The fluid system of claim 2 wherein the flow bypass means includes bypass valve means for varying the fluid flow delivered to the fluid system to establish a second relatively constant pressure differential across the variable orifice means.

4. The fluid system of claim 3 wherein the second relatively constant pressure differential is larger than the first relatively constant pressure differential.

5. The fluid system of claim 4 wherein the control means includes signal generating means for generating a control signal.

6. The fluid system of claim 5 wherein the first flow changing means is supplied with energy from the discharge pressure of the fluid pump and the second flow changing means is supplied with energy from the signal generating means.

7. The fluid system of claim 5 wherein the first and second flow changing means are supplied with energy from the discharge pressure of the fluid pump.

8. The fluid system of claim 7 wherein the pump displacement changing means of the fluid pump has force generating means for urging the pump displacement changing means towards the maximum flow position and the signal generating means includes a source of pressurized fluid operatively connected to the force generating means and acts in parallel therewith.

9. The fluid system of claim 8 wherein the force generating means includes spring biasing means.

10. The fluid system of claim 1 wherein the valve means includes variable orifice means for establishing a differential pressure thereacross and the first flow changing means includes pump control means having pilot valve means for controlling the pump displacement changing means and is responsive to the pressure differential across the variable orifice means in the valve means.

11. The fluid system of claim 10 wherein the second flow changing means includes pilot valve means for controlling the flow bypass means and is responsive to the pressure differential across the variable orifice means in the valve means.

12. The fluid system of claim 10 wherein the flow bypass means includes single stage bypass valve means for bypassing fluid from the fluid pump to the reservoir and is responsive to the pressure differential across the variable orifice means in the valve means.

* * * * *